US011699388B2

(12) United States Patent
Yoon et al.

(10) Patent No.: US 11,699,388 B2
(45) Date of Patent: Jul. 11, 2023

(54) DISPLAY DEVICE AND METHOD OF DRIVING THE SAME BASED ON PREVIOUS FRAME LOAD

(71) Applicant: SAMSUNG DISPLAY CO., LTD., Yongin-si (KR)

(72) Inventors: Hyun Sik Yoon, Yongin-si (KR); Jong Woon Kim, Yongin-si (KR); Ick Kyu Jang, Yongin-si (KR); Dae Ho Hwang, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/591,078

(22) Filed: Feb. 2, 2022

(65) Prior Publication Data

US 2022/0398974 A1 Dec. 15, 2022

(30) Foreign Application Priority Data

Jun. 14, 2021 (KR) ..... 10-2021-0077062

(51) Int. Cl.
*G09G 3/32* (2016.01)

(52) U.S. Cl.
CPC ..... *G09G 3/32* (2013.01); *G09G 2310/0272* (2013.01)

(58) Field of Classification Search
CPC ..... G09G 3/32
USPC ..... 345/55
See application file for complete search history.

(56) References Cited

U.S. PATENT DOCUMENTS

| | | | | |
|---|---|---|---|---|
| 8,503,220 | B2 | 8/2013 | Kim et al. | |
| 9,147,360 | B2 | 9/2015 | Oh et al. | |
| 9,836,815 | B2 | 12/2017 | Wang | |
| 2012/0044270 | A1* | 2/2012 | Arkhipov | G09G 3/32 345/690 |
| 2014/0354699 | A1* | 12/2014 | Shin | G09G 3/2022 345/690 |

FOREIGN PATENT DOCUMENTS

| | | |
|---|---|---|
| KR | 10-0757567 | 9/2007 |
| KR | 10-1456958 | 10/2014 |
| KR | 10-1492727 | 2/2015 |
| KR | 10-1652785 | 8/2016 |

* cited by examiner

*Primary Examiner* — Long D Pham
(74) *Attorney, Agent, or Firm* — F. Chau & Associates, LLC

(57) ABSTRACT

A display device includes: a display panel including pixels emitting light, based on a data voltage; a current limiter for determining a scale factor by comparing a previous frame load with a predetermined threshold load, and generating compensated image data by applying the scale factor to current image data as input image data of a current frame to adjust the data voltage; and a data driver for converting the compensated image data into the data voltage and providing the data voltage to the display panel.

20 Claims, 9 Drawing Sheets

DISPLAY DEVICE AND METHOD OF DRIVING THE SAME BASED ON PREVIOUS FRAME LOAD

CROSS-REFERENCE TO RELATED APPLICATION

The present application claims priority under 35 U.S.C. § 119 to Korean patent application 10-2021-0077062 filed on Jun. 14, 2021, in the Korean Intellectual Property Office, the entire disclosure of which is herein incorporated by reference.

TECHNICAL FIELD

The present disclosure relates generally to display devices, and more particularly to a display device with adjustable scale factor and a method of driving the same.

DISCUSSION OF RELATED ART

A display device may include pixels, and each of a plurality of image frames displayed by the pixels may have a frame load corresponding to image data of the corresponding frame.

For example, an image frame of a bright image may have a large frame load value, and an image frame of a dark image may have a small frame load value. Alternatively, the frame load may increase as the number of pixels emitting light among substantially all of the pixels increases.

The amount of electrical current which the pixels use may increase as the frame load becomes larger. Similarly, the amount of electrical current which the pixels use may decrease as the frame load becomes smaller.

SUMMARY

Embodiments of the present disclosure provide a display device for adjusting a scale factor applied to input image data of a current frame, based on a result obtained by comparing a previous frame load with a threshold load.

In accordance with an embodiment of the present disclosure, there is provided a display device including: a display panel including pixels emitting light, based on a data voltage; a current limiter configured to determine a scale factor by comparing a previous frame load with a predetermined threshold load, and generate compensated image data by applying the scale factor to current image data as input image data of a current frame to adjust the data voltage; and a data driver configured to convert the compensated image data into the data voltage and provide the data voltage to the display panel.

When the previous frame load is smaller than the threshold load, and a current frame load is greater than the threshold load, a scale factor of the current frame may be smaller than that of a previous frame.

The current limiter may generate a time weight, based on the previous frame load and a frame lapse time, and further apply the time weight to the scale factor.

The scale factor and the time weight may be greater than 0 and be equal to or smaller than 1.

When a frame load of a first frame is equal to or smaller than the threshold load, and frame loads of second to kth (k is an integer greater than 2) frames are greater than the threshold load, the magnitude of a data voltage corresponding to the same grayscale may be gradually decreased as approaching the kth frame from the second frame.

The scale factor to which the time weight is applied may be gradually decreased as approaching the kth frame from the second frame.

The current limiter may include: a load calculator configured to calculate the previous frame load, based on input image data of a previous frame; a signal controller configured to compare the previous frame load with the threshold load, and output a first control signal, based on a comparison result; and a scale factor adjustor configured to adjust the scale factor, based on the previous frame load and the first control signal.

When the previous frame load is smaller than the threshold load, the signal controller may activate the first control signal. The scale factor adjustor may generate a current scale factor by applying a compensation coefficient to a load scale factor corresponding to the previous frame load in response to the first control signal.

When the previous frame load is equal to or greater than the threshold load, the signal controller may inactivate the first control signal. The scale factor adjustor may output, as the current scale factor, a previous scale factor output in the previous frame.

When the previous frame load is smaller than the threshold load, the signal controller may further output a second control signal activated during a buffer period including a plurality of frames.

The current limiter may further include: a counter configured to output a count value by counting frames of the buffer period; a weight generator configured to generate a time weight which varies in the buffer period in response to the second control signal and the count value; and a calculator configured to apply the time weight to the current scale factor.

The current limiter may further include a resetter configured to output a count reset signal when both the first control signal and the second control signal are activated. The counter may reset the count value in response to the count reset signal.

The weight generator may output a first time weight corresponding to a first frame of the buffer period in response to the count reset signal.

The signal controller may include: a lookup table including a load scale factor corresponding to the previous frame load; and a comparator configured to output a second control signal for controlling generation of the first control signal and the time weight by comparing the previous frame load with the threshold load.

The current limiter may generate the compensated image data by applying, to the current image data, the current scale factor to which the time weight is applied.

In accordance with an embodiment of the present disclosure, a display controller includes a current limiter configured to receive a plurality of first image data representing a first frame, determine a first scale factor based on an electrical current load of the first frame plus a threshold, receive a plurality of second image data representing a second frame, and scale the plurality of second image data based on the first scale factor, wherein a plurality of pixels are configured to display the second frame by emitting light based on the scaled plurality of second image data with an electrical current load of the second frame no more than the electrical current load of the first frame plus the threshold.

The threshold of the display controller may be a fixed threshold. The threshold of the display controller may be a variable threshold proportional to the electrical current load of the first frame. The threshold of the display controller may be no more than the remaining current headroom for the plurality of pixels.

In accordance with an embodiment of the present disclosure, there is provided a method of driving a display device, the method including: comparing a previous frame load with a predetermined threshold load; activating a first control signal and a second control signal, when the previous frame load is smaller than the threshold load; generating a first scale factor by applying a compensation coefficient to a load scale factor corresponding to the previous frame load, based on the first control signal; generating a time weight, based on the activation of the second control signal; outputting a current scale factor by applying the time weight to the first scale factor; and providing a data voltage to a display panel by applying the current scale factor to current image data.

The second control signal may be activated during a buffer period including a plurality of frames.

The method may further include: inactivating the first control signal, when the previous frame load is equal to or greater than the threshold load; generating the time weight, based on the second control signal; outputting the current scale factor by applying the time weight to a scale factor output in a previous frame; and providing a data voltage to the display panel by applying the current scale factor to current image data.

The time weight may be determined by counting frames of the buffer period.

When the previous frame load is smaller than the threshold load, and a current frame load is greater than the threshold load, a scale factor of the current frame may be smaller than that of a previous frame.

In a display device and the method of driving the same in accordance with an embodiment of the present disclosure, a scale factor applied to current image data can be adjusted for current limitation, based on a previous frame load without comparing image data (or frame loads) of adjacent frames, using a frame memory.

Accordingly, image quality may be maximized, without degradation due to generation and application of a scale factor delayed by one frame according to an image data comparison using a frame memory, and power consumption may be minimized. The adjustment of a scale factor may be reflected substantially immediately (e.g., in real time) based on the previous frame load, and an over-current (overshoot of current) may be prevented such as when the frame load (or the amount of electrical current through the display panel) rapidly increases.

Moreover, the scale factor applied to the current image data may be gradually decreased toward the target scale factor by the time weight provided throughout a few frames (e.g., during the buffer period), and image distortion or the like may be reduced, such as due to electrical current limitation corresponding to a rapid change in frame load.

DETAILED DESCRIPTION

Figure 1:
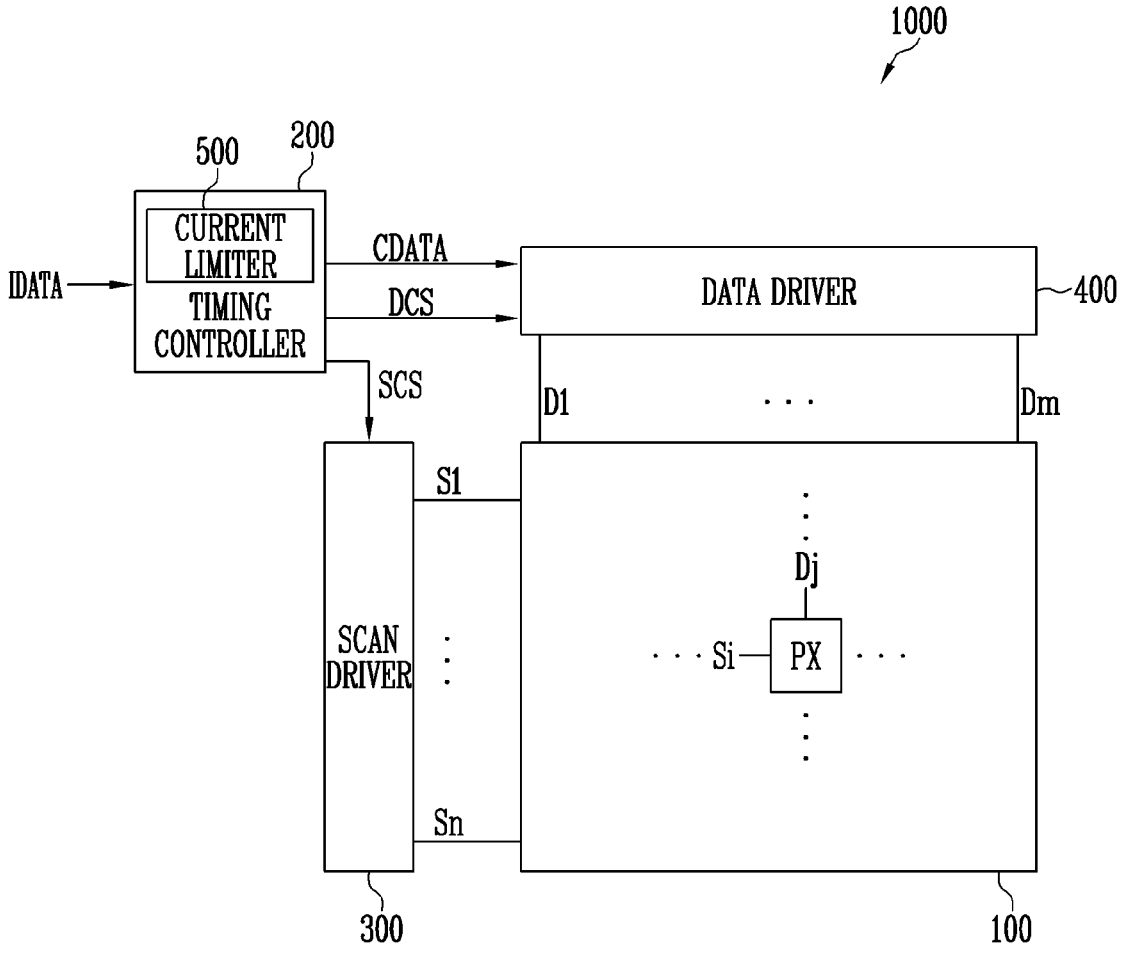
FIG. 1 is a block diagram illustrating a display device in accordance with an embodiment of the present disclosure.

Hereinafter, embodiments of the present disclosure will be described in detail with reference to the accompanying drawings. Throughout the drawings, the same or like reference numerals may be applied to the same or like elements, and substantially duplicate description may be omitted.

FIG. 1 illustrates a display device in accordance with an embodiment of the present disclosure.

Referring to FIG. 1, the display device 1000 may include a display panel 100, a timing controller 200, a scan driver 300, a data driver 400, and a current limiter 500.

The display panel 100 may include scan lines S1 to Sn and data lines D1 to Dm, and include pixels PX connected to the scan lines S1 to Sn and the data lines D1 to Dm (m and n are integers greater than 1). Each of the pixels PX may include a driving transistor and at least one switching transistor. For example, the pixel PX may be connected to an ith scan line Si (i is a positive integer equal to or less than n) and a jth data line Dj (j is a positive integer equal to or less than m), and emit light, based on a data voltage (data signal).

The timing controller 200 may generate a scan control signal SCS and a data control signal DCS, corresponding to synchronization signals supplied from the outside. The scan control signal SCS may be supplied to the scan driver 300, and the data control signal DCS may be supplied to the data driver 400. Also, the timing controller 200 may supply, to the data driver 400, compensated image data realigned based on input image data IDATA supplied from the outside. In an embodiment the timing controller 200 may include at least some functions of the current limiter 500.

The current limiter 500 may calculate a previous frame load by using input image data IDATA of a previous frame. The current limiter 500 may control a current amount flowing into the display panel 100 in a current frame, based on the previous frame load. When the current amount flowing into the display panel 100 decreases, the luminance of an image of the corresponding frame may decrease.

As described above, the current limiter 500 performs a current limit function of lowering the luminance of an image and decreasing the current amount. Thus, power consumption of the display device 1000 can be reduced, and degradation of the pixels PX can be reduced or prevented.

In an embodiment, the current limiter 500 may adjust a scale factor applied to current image data as input image data IDATA of the current frame, based on the previous frame load. The previous frame load may be a frame load of the previous frame, which is calculated from previous input image data. For example, the frame load may be quantified as 0% to 100%, based on image data of the corresponding frame. A frame load of 0% may be a full-black image, and a frame load of 100% may be a full-white image as the brightest image of the corresponding display device 1000.

The frame load may be determined based on a representative value calculated from grayscale values of the corresponding frame and/or a ratio of pixels emitting light in the corresponding frame to substantially all of the pixels.

Compensated image data CDATA of the current frame, to which the scale factor is applied, may have a value equal to or smaller than the current image data. Therefore, the frame load of the current frame may be decreased, and the current amount and luminance of the display panel 100 in the current frame may become lower than an expected value corresponding to the current image data.

The current limiter 500 may determine a scale factor, based on a result obtained by comparing the previous frame load with a predetermined threshold load. In an embodiment, when the previous frame load is smaller than the threshold load and the current frame load is greater than the threshold load, a scale factor of the current frame may be smaller than that of the previous frame.

When the frame load rapidly increases (e.g., when the image frame is changed from a black image to a bright image such as a white image), there may occur an over-current which instantaneously exceeds a current amount corresponding to the corresponding frame load according to a rapid increase in current amount. Therefore, instantaneous image quality abnormality may be viewed. In addition, an over-current protection function is activated by an over-current caused by an increase in frame load in a display device to which the over-current protection function is applied, and therefore, image display may be shut down.

In related art, such an over-current might be prevented where a rapid change in frame load is detected by comparing previous image data with current image data. However, a frame memory used to store image data or compare image data of adjacent frames might cause an increase in manufacturing cost or an increase in power consumption.

The current limiter 500 in accordance with an embodiment of the present disclosure may adjust a scale factor by analyzing a previous frame load without any frame memory. When a frame load rapidly increases, the current limiter 500 may reduce a rapid change in luminance and current by decreasing the scale factor.

In an embodiment, the current limiter 500 may generate a time weight, based on the previous frame load and a frame lapse time. The time weight may be further applied to the scale factor. Accordingly, the frame load may be gradually decreased toward a target frame load according to a frame lapse. The scale factor and the time weight may be greater than 0 and be equal to or smaller than 1.

For example, when a frame load of a first frame is equal to or smaller than the threshold load, and image data of second to kth frames (where k is an integer greater than 2) having frame loads greater than the threshold load are substantially the same, the magnitude of a data voltage may be gradually decreased corresponding to each of the second to kth frames.

The current limiter 500 may provide the compensated image data CDATA to the data driver 400. As shown in FIG. 1, the current limiter 500 may be included in the timing controller 200. However, this is merely illustrative, and at least some function of the current limiter 500 may be provided as a physical component separate from the timing controller 200 to the display device 1000.

The scan driver 300 may receive the scan control signal SCS from the timing controller 200, and supply a scan signal to the scan lines S1 to Sn, based on the scan control signal SCS. For example, the scan driver 300 may sequentially supply the scan signal to the scan lines S1 to Sn.

A transistor which is included in the pixel PX and receives the scan signal may be turned on in response to a gate-on level of the scan signal.

The data driver 400 may receive the data control signal DCS and the compensated image data CDATA from the timing controller 200. The compensated image data CDATA may be directly provided from the current limiter 500. The data driver 400 may convert the compensated image data CDATA into a data signal in an analog form. The data driver 400 may supply a data voltage (or data signal) to the data lines D1 to Dm, corresponding to the data control signal DCS. The data voltage may be supplied to pixels PX selected by the scan signal.

Meanwhile, although n scan lines S1 to Sn have been illustrated in FIG. 1, the present disclosure is not limited thereto. In an example, additional scan lines and/or emission control lines may be additionally formed in the display panel 100.

Meanwhile, although a case where the data driver 400 and the timing controller 200 are components separate from each other has been illustrated in FIG. 1, at least some functions of the data driver 400, the timing controller 200, and the current limiter 500 may be integrated in the form of an integrated circuit (IC).

Figure 2A:
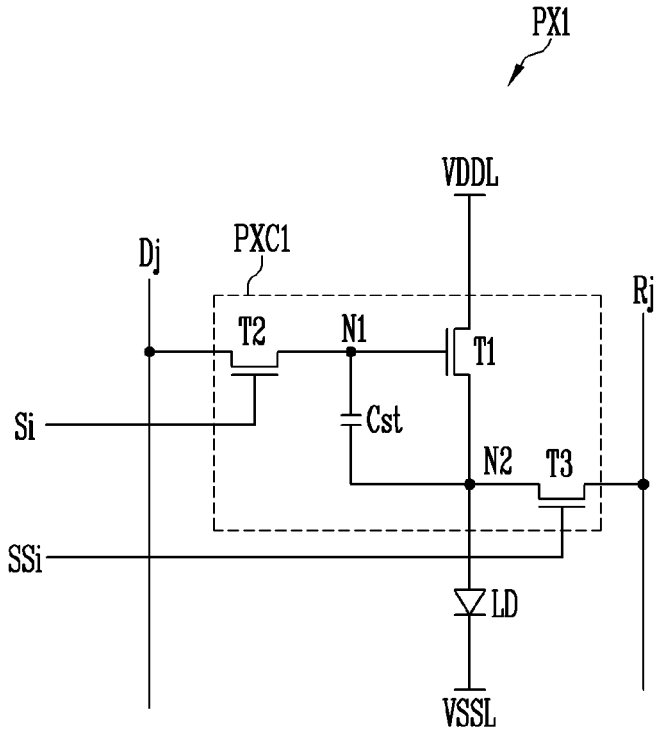
FIGS. 2A and 2B are circuit diagrams illustrating examples of a pixel included in the display device shown in FIG. 1.
Figure 2B:
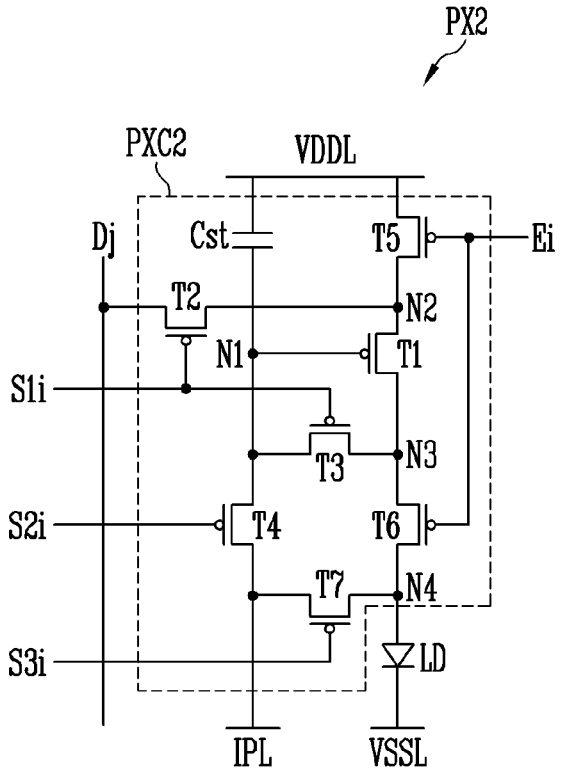

FIGS. 2A and 2B illustrate examples of the pixel included in the display device shown in FIG. 1.

For convenience of description, pixels PX1 and PX2 which are located on an ith pixel row (or ith horizontal line) and are connected to a jth data line Dj will be described in FIGS. 2A and 2B (where i and j are natural numbers).

First, referring to FIG. 2A, the pixel PX1 may include a pixel circuit PXC1 and a light emitting element LD. The pixel circuit PXC1 may include transistors T1, T2, and T3 and a storage capacitor Cst.

In FIG. 2A, a circuit implemented with an N-type transistor is described as an example. However, those skilled in the art may design a circuit implemented with a P-type transistor by changing the polarity of a voltage applied to a gate terminal. Similarly, those skilled in the art may design a circuit implemented with a combination of the P-type transistor and the N-type transistor. The transistor may be configured in various forms including a Thin Film Transistor (TFT), a Field Effect Transistor (FET), a Bipolar Junction Transistor (BJT), and the like.

A first transistor T1 may be connected between a first power line VDDL and the storage capacitor Cst. A gate electrode of the first transistor T1 may be connected to a first electrode of the storage capacitor Cst. The first transistor T1 may be a driving transistor.

A second transistor T2 may be connected between the jth data line Dj and the gate electrode of the first transistor T1 (e.g., a first node N1). A gate electrode of the second transistor T2 may be connected to an ith scan line Si. The second transistor T2 may be turned on when a scan signal is supplied to the ith scan line Si, to transfer a data signal (or data voltage) from the jth data line Dj to the first node N1.

A third transistor T3 may be connected between a jth readout line Rj and one electrode of the first transistor T1 (e.g., a second node N2). In an embodiment, a gate electrode of the third transistor T3 may be connected to an ith sensing scan line SSi. The third transistor T3 may transfer a sensing current to the jth readout line Rj in response to a sensing scan signal supplied to the ith sensing scan line SSi. For example, the sensing current may be used to calculate a mobility of the first transistor T1 and a variation of a threshold voltage of the first transistor T1. Information on the mobility and the threshold voltage may be calculated according to a relationship between the sensing current and a voltage for sensing. In an embodiment, the sensing current may be converted into a voltage form to be used in a compensation operation.

In an embodiment, the light emitting element LD may be an organic light emitting diode including an organic emitting layer. In another embodiment, the light emitting element LD may be an inorganic light emitting element formed of an inorganic material. In another embodiment, the light emitting element LD may be a light emitting element configured with a combination of an inorganic material and an organic material. In another embodiment, an anode of the light emitting element LD may be connected to the first power line VDDL, and a cathode of the light emitting element LD may be connected to a first electrode of the first transistor T1.

A first power voltage may be applied to the first power line VDDL, and a second power voltage may be applied to a second power line VSSL. For example, the first power voltage may be higher than the second power voltage.

A positive driving current corresponding to a voltage difference between the first electrode and a second electrode of the storage capacitor Cst flows between the first electrode and a second electrode of the first transistor T1. Accordingly, the light emitting element LD emits light with a luminance corresponding to the data voltage. Since the magnitude of the data voltage is adjusted based on the scale factor, the driving current of the pixel PX1 can be adjusted.

In an embodiment, referring to FIG. 2B, the pixel PX2 may include a pixel circuit PXC2 and a light emitting element LD. The pixel circuit PXC2 may include transistors T1 to T7 and a storage capacitor Cst.

In FIG. 2B, a circuit implemented with a P-type transistor is described as an example. However, those skilled in the art may design a circuit implemented with an N-type transistor by changing the polarity of a voltage applied to a gate terminal. Similarly, those skilled in the art may design a circuit implemented with a combination of the P-type transistor and the N-type transistor.

A first electrode (e.g., an anode) of the light emitting element LD may be connected to a fourth node N4, and a second electrode (e.g., a cathode) of the light emitting element LD may be connected to a second power line VSSL. The light emitting element LD may generate light with a predetermined luminance, corresponding to a current amount (or driving current) supplied from a first pixel transistor T1.

A first transistor T1 (or driving transistor) may be electrically connected between a first power line VDDL and the first electrode of the light emitting element LD. The first transistor T1 may include a gate electrode connected to a first node N1.

A second transistor T2 may be connected between the jth data line Dj (hereinafter, referred to as a data line) and a second node N2. A gate electrode of the second transistor T2 may be connected to an ith first scan line S1*i* (hereinafter, referred to as a first scan line). The second transistor T2 may be turned on when a first scan signal is supplied to the first scan line S1*i*, to electrically connect the data line Dj and the second node N2 to each other.

A third transistor T3 may be connected between the first node N1 and a third node N3. A gate electrode of the third transistor T3 may be connected to the first scan line S1*i*. The third transistor T3 may be turned on simultaneously with the second transistor T2.

A fourth transistor T4 may be connected between the first node N1 and an initialization power line IPL for transferring a voltage of an initialization power source. A gate electrode of the fourth transistor T4 may be connected to an ith second scan line S2*i* (hereinafter, referred to as a second scan line). The fourth transistor T4 may be turned on by a second scan signal supplied to the second scan line S2*i*. When the fourth transistor T4 is turned on, the voltage of the initialization power source may be supplied to the first node N1 (e.g., the gate electrode of the first transistor T1). In an embodiment, a timing of the second scan signal supplied to the second scan line S2*i* may be equal to that of a scan signal supplied to an (i−1)th first scan line (e.g., S1*i*−1).

A fifth transistor T5 may be connected between the first power line VDDL and the second node N2. A gate electrode of the fifth transistor T5 may be connected to an ith emission control line Ei (hereinafter, referred to as an emission control line). A sixth transistor T6 may be connected between the third node N3 and the light emitting element LD (or the fourth node N4). A gate electrode of the sixth transistor T6 may be connected to the emission control line Ei. The fifth transistor T5 and the sixth transistor T6 may be turned off when an emission control signal is supplied to the emission control line Ei, and be turned on in other cases.

In some embodiments, when the fifth and sixth transistors T5 and T6 are turned on, a current flowing through the first pixel transistor T1 may be transferred to the light emitting element LD, and the light emitting element LD may emit light.

A seventh transistor T7 may be connected between the first electrode of the light emitting element LD (e.g., the fourth node N4) and the initialization power line IPL. A gate electrode of the seventh transistor T7 may be connected to an ith third scan line S3*i* (hereinafter, referred to as a third scan line). The seventh transistor T7 may be turned on by a third scan signal supplied to the third scan line S3*i*, to supply the voltage of the initialization power source to the first electrode of the light emitting element LD. In an embodiment, a timing of the third scan signal supplied to the third scan line S3*i* may be equal to that of one of scan signals supplied to the first scan line S1*i*, the (i−1)th first scan line S1*i*−1, and an (i+1)th first scan line (e.g., S1*i*+1).

The storage capacitor Cst may be connected between the first power line VDDL and the first node N1.

In an embodiment, the first scan signal may be supplied after the second scan signal is supplied. For example, the second scan signal and the first scan signal may be supplied with a difference of one horizontal period.

In an embodiment, the third scan signal may be supplied simultaneously with the first scan signal. However, this is merely illustrative, and the first scan signal may be supplied after the third scan signal is supplied. For example, a supply interval of the third scan signal and the first scan signal may be one horizontal period. Alternatively, the third scan signal may be supplied after the first scan signal is supplied.

The pixels PX1 and PX2 shown in FIGS. 2A and 2B are merely illustrative, and the embodiments of the present disclosure may be applied to pixels of another circuit.

Figure 3:
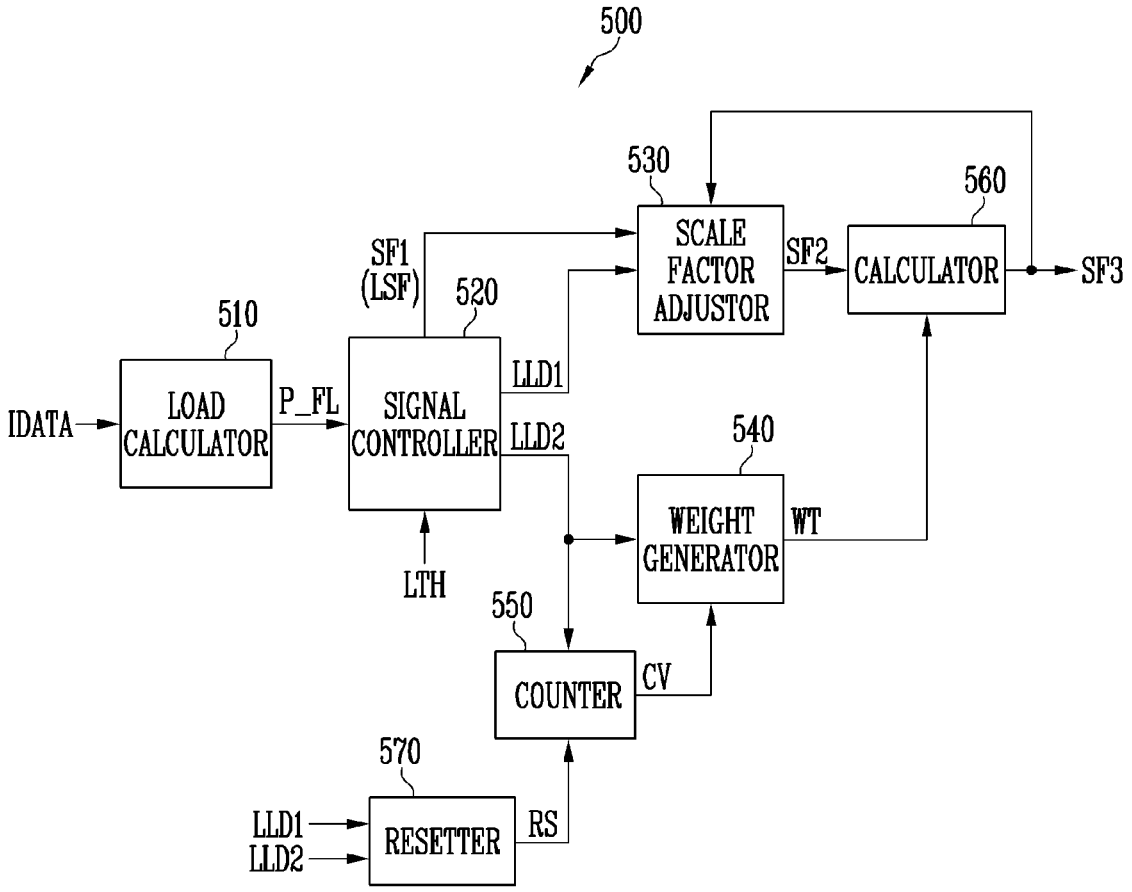
FIG. 3 is a block diagram illustrating an example of a current limiter included in the display device shown in FIG. 1.
Figure 4:
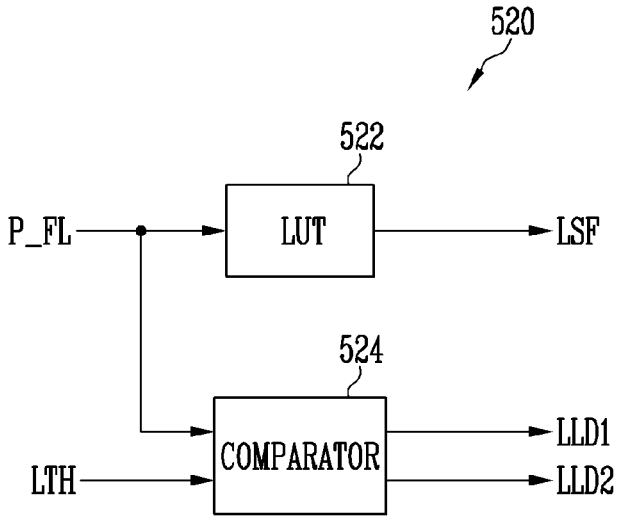
FIG. 4 is a block diagram illustrating an example of a signal controller included in the current limiter shown in FIG. 3.

FIG. 3 illustrates an example of the current limiter included in the display device shown in FIG. 1. FIG. 4 illustrates an example of a signal controller included in the current limiter shown in FIG. 3.

Referring to FIGS. 1, 3, and 4, the current limiter 500 may include a load calculator 510, a signal controller 520, and a scale factor adjustor 530. In an embodiment, the current limiter 500 may further include a weight generator 540, a counter 550, a calculator 560, and a resetter 570.

The load calculator 510 may calculate a previous frame load P_FL, based on input image data IDATA of a previous frame. In an embodiment, the load calculator 510 may calculate the previous frame load P_FL by analyzing information of grayscale values included in the input image data IDATA and/or emission ratio information of the pixels. Alternatively, information associated with the frame load may be included in the input image data IDATA. For example, the previous frame load P_FL may include information within a range quantified as 0% to 100%.

The load calculator 510 may include a hardware circuit and/or a software algorithm, used to output the previous frame load P_FL, based on the input image data IDATA of the previous frame. The load calculator 510 may provide the previous frame load P_FL to the signal controller 520.

The signal controller 520 may compare the previous frame load P_FL with a threshold load LTH, and output a first control signal LLD1, based on a comparison result. For example, the threshold load LTH may be determined as a value selected in a range of 1% to 10%. However, this is merely illustrative, and the value of the threshold load LTH is not limited thereto.

In an embodiment, when the previous frame load P_FL is smaller than the threshold load LTH, the signal controller 520 may activate the first control signal LLD1. The first control signal LLD1 may be provided to the scale factor adjustor 530. When the previous frame load P_FL is equal to or greater than the threshold load LTH, the signal controller 520 may inactivate the first control signal LLD1.

In an embodiment, when the previous frame load P_FL is smaller than the threshold load LTH, the signal controller 520 may further output a second control signal LLD2 activated during a buffer period including a plurality of frames. The second control signal LLD2 is a signal for outputting a time weight WT. The second control signal LLD2 may be provided to the weight generator 540 and the counter 550.

Also, the signal controller 520 may output, as a first scale factor SF1, a load scale factor LSF corresponding to the previous frame load P_FL. The first scale factor SF1 may be provided to the scale factor adjustor 530.

In an embodiment, as shown in FIG. 4, the signal controller 530 may include a lookup table 522 and a comparator 524.

The lookup table 522 may output the load scale factor LSF corresponding to the previous frame load P_FL. For example, the lookup table 522 may include scale factor values corresponding to each of predetermined frame loads, and output, as the load scale factor LSF, one corresponding to the previous frame load P_FL among the scale factor values. The scale factor values may be included in a range of no less than 0 and no more than 1. For example, the scale factor value may become smaller as the previous frame load P_FL becomes larger.

The comparator 524 may compare the previous frame load P_FL with the threshold load LTH. The comparator 524 may output the first control signal LLD1 and the second control signal LLD2, based on a comparison result. For example, both the first control signal LLD1 and the second control signal LLD2 may be changed from an inactivation level to an activation level when the previous frame load P_FL is smaller than the threshold load LTH. Therefore, the first control signal LLD1 and the second control signal LLD2 may be understood as low-load detection signals.

The comparator 524 may be implemented with various types of comparison circuits and/or various types of comparison algorithms, known in the art.

The scale factor adjustor 530 may adjust a scale factor, based on the previous frame load P_FL and the first control signal LLD1. For example, the scale factor adjustor 530 may select one of the load scale factor LSF (e.g., the first scale factor SF1) and a previous scale factor output in the previous frame (e.g., a third scale factor SF3 of the previous frame), based on the first control signal LLD1, and output the selected scale factor as a current scale factor (e.g., a second scale factor SF2).

In an embodiment, the scale factor adjustor 530 may generate the second scale factor SF2 (e.g., SF2=LSF*CC) by applying a compensation coefficient (e.g., CC shown in FIG. 5) to the load scale factor LSF in response to the first control signal LLD1 (e.g., the activation level of the first control signal LLD1). For example, when the calculator 560 does not operate or when the time weight WT is 1, the second scale factor SF2 and the third scale factor SF3 may be the same. The second scale factor SF2 may be applied to input image data IDATA of a current frame.

In an embodiment, when the first control signal LLD1 is inactivated (e.g., when the previous frame load P_FL is equal to or greater than the threshold load LTH), the scale factor adjustor 530 may output the previous scale factor as the second scale factor SF2. For example, the scale factor adjustor 530 may receive the third scale factor SF3 generated corresponding to the previous frame and store the third scale factor SF3 during one frame.

Alternatively, in an embodiment, when the first control signal LLD1 is inactivated (e.g., when the previous frame load P_FL is equal to or greater than the threshold load LTH), the scale factor adjustor may output the load scale factor LSF as the second scale factor SF2.

The counter 550 may count frames of the buffer period in which the activated second control signal LLD2 is output. In some embodiments, the counter 550 may be a frame counter. For example, the counter 550 may count a number of frames in which the second control signal LLD2 is output corresponding to a vertical synchronization signal output for each frame. The buffer period may correspond to the number of consecutive frames used for a frame load to reach a target frame load due to the time weight WT. The scale factor output during the buffer period may be gradually decreased to the target scale factor.

For example, the buffer period may be set to six consecutive frames, and the second control signal LLD2 may be activated during six frames. However, this is merely illustrative, and the length of the buffer period is not limited thereto.

The counter 550 may provide a count value CV to the weight generator 540.

The weight generator 540 may generate a time weight WT which varies within the buffer period in response to the second control signal LLD2 and the count value CV. For example, the weight generator 540 may include first to sixth time weights respectively corresponding to first to sixth frames included in the buffer period. For example, the first time weight may be output in the first frame, and the sixth time weight may be output in the sixth frame.

In an embodiment, when the second control signal LLD2 is inactivated, the weight generator 540 may not output the time weight WT, or the time weight WT may be 1. When the time weight WT is not output, the calculator 560 does not operate.

For example, the weight generator 540 may be activated in response to the second control signal LLD2, and output a time weight WT corresponding to the count value CV. The weight generator 540 may include a memory or a lookup table, in which values of the time weight WT are stored.

The calculator 560 may generate the third scale factor SF3 by applying the time weight WT to the second scale factor SF2. For example, the calculator 560 may include a multiplier. The third scale factor SF3 may be applied to the current image data. The current image data to which the third scale factor SF3 is applied may be provided as compensated image data CDATA to the data driver 400.

The resetter 570 may output a count reset signal RS, based on the first control signal LLD1 and the second control signal LLD2. The signal controller 520 may provide the resetter 570 with the first control signal LLD1 and the second control signal LLD2.

When both the first and second control signals LLD1 and LLD2 are activated, the resetter 570 may output the count reset signal RS. The count reset signal RS may be provided to the counter 550.

The counter 550 may reset the count value CV in response to the count reset signal RS. The weight generator 540 may output a first time weight corresponding to the first frame of the buffer period in response to the count reset signal RS. For example, the counter 550 may output the count value CV indicating the first frame of the buffer period in response to the count reset signal RS, and the weight generator 540 may output the first time weight in response to the count value CV.

As described above, the display device 1000 in accordance with the embodiments of the present disclosure may adjust the scale factor applied to the current image data, based on the previous frame load P_FL without comparing image data (or frame loads) of adjacent frames using the frame memory. For example, when the current frame load is greater than the threshold load LTH while the previous frame load P_FL is smaller than the threshold load LTH, the scale factor (e.g., the third scale factor SF3) of the current frame may be smaller than that of the previous frame.

Accordingly, image quality degradation due to generation and application of a scale factor delayed by one frame according to image data comparison by using the frame memory may be improved, and power consumption may be further reduced. In addition, since the adjustment of a scale factor is immediately reflected based on the previous frame load P_FL, an over-current (overshoot of current) when the frame load (and the current amount of the display panel 100) rapidly increases may be prevented.

Further, since the third scale factor SF3 may be gradually decreased toward the target scale factor by the time weight WT provided throughout a few frames (e.g., during the buffer period), image distortion or the like due to current limitation corresponding to a rapid change in frame load may be reduced.

Figure 5:
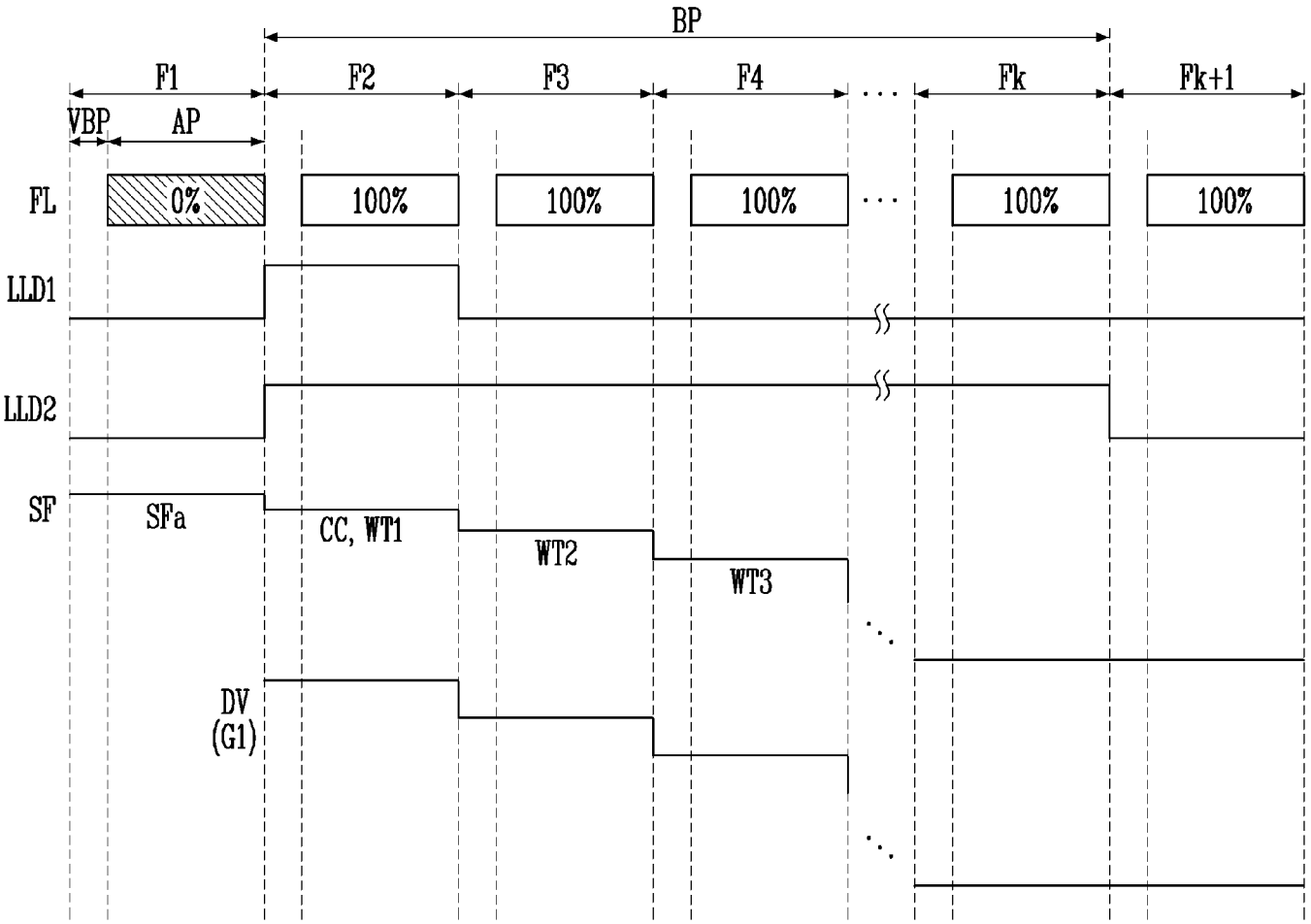
FIG. 5 is a timing diagram illustrating an example of an operation of the current limiter shown in FIG. 3, which adjusts a scale factor according to a frame load.

FIG. 5 illustrates an example of an operation of the current limiter shown in FIG. 3, which adjusts a scale factor according to a frame load.

Referring to FIGS. 3 and 5, the first and second control signals LLD1 and LLD2 and a scale factor SF may be controlled based on a frame load FL of a previous frame.

In an embodiment, each of frames F1 to Fk+1 (k is an integer greater than 5) may include a vertical blank period VBP and an active period AP. Any data voltages associated with an image are not output in the vertical blank period VBP, and data voltages of an image of a corresponding frame may be output in the active period AP.

FIG. 5 illustrates an example of a case where an image is changed from a low frame load to a high frame load. A frame load FL of a first frame F1 may be 0% (e.g., a black image). The frame load FL of the first frame F1 may be smaller than the threshold load LTH. Frame loads FL of second to (k+1)th frames F2 to Fk+1 may be 100% (e.g., a full-white image). The frame loads FL of the second to (k+1)th frames F2 to Fk+1 may be greater than the threshold load LTH.

A scale factor SF applied to a current frame may be determined based on the frame load FL of the previous frame. A predetermined scale factor SFa may be applied to image data (input image data) of the first frame F1 by a frame load FL of a frame prior to the first frame F1.

Since the frame load FL of the first frame F1 is smaller than the threshold load LTH, the first control signal LLD1 and the second control signal LLD2 may be activated in the second frame F2. A compensation coefficient CC may be applied to the scale factor SFa of the first frame F1 (e.g., SFa*CC) in response to the first control signal LLD1. The compensation coefficient CC may be greater than 0 and be smaller than or equal to 1.

The compensation coefficient CC may be a unique value set according to characteristics of the display panel 100. Alternatively, the compensation coefficient CC may additionally vary according to the value of the frame load FL of the previous frame.

In an embodiment, the second control signal LLD2 may be activated during a predetermined buffer period BP. For example, the buffer period BP may be a period including (k−1) frames.

The second frame F2 is a first frame in which the second control signal LLD2 is activated. Therefore, in the second frame F2, a first time weight WT1 may be further applied the scale factor SFa (e.g., SF1*CC*WT1). The first time weight WT1 may be greater than 0 and be smaller than 1. Accordingly, a scale factor SF applied to image data of the second frame F2 may be smaller than the scale factor SFa of the first frame F1.

The scale factor (SF1*CC*WT1) of the second frame F2 may be determined within a vertical blank period VBP of the second frame F2. Accordingly, the scale factor (SF1*CC*WT1) of the second frame F2 may be applied to the image data of the second frame F2, and data voltages to which the scale factor (SF1*CC*WT1) is reflected may be provided to the display panel 100 in an active period AP of the second frame F2.

Since a frame load FL of the second frame F2 is greater than the threshold load LTH, the first control signal LLD1 may be inactivated in the third frame F3. In addition, the second control signal LLD2 may maintain the activation level in the second frame F2. Accordingly, the scale factor adjustor 530 may provide the calculator 560 with a scale factor SF (e.g., SFa*CC*WT1) output in the second frame F2 as a second scale factor SF2. The weight generator 540 may output a second time weight WT2 in response to a count value CV of the second control signal LLD2, which is counted as 2 (e.g., two frames are counted).

Accordingly, the calculator 560 applies the second time weight WT2 to the second scale factor SF2, so that a new scale factor (e.g., SFa*CC*WT1*WT2) can be applied to image data of the third frame SF3.

Similarly, a scale factor (e.g., SFa*CC*WT1*WT2*WT3) obtained by further applying a third time weight WT3 to the scale factor (e.g., SFa*CC*WT1*WT2) of the third frame SF3 may be applied to image data of the fourth frame SF4.

As described above, the scale factor SF may be gradually decreased until the kth frame Fk in which the buffer period BP is ended. The value of a first grayscale G1 may be gradually decreased, and a data voltage DV corresponding to the first grayscale G1 may also be gradually decreased. Accordingly, the current amount of the display panel 100 and an actual frame load may be gradually decreased according to a frame lapse.

Subsequently, a scale factor SF having the same value as the scale factor SF of the kth frame Fk may be applied to the (k+1)th frame Fk+1 after the buffer period BP.

Figure 6:
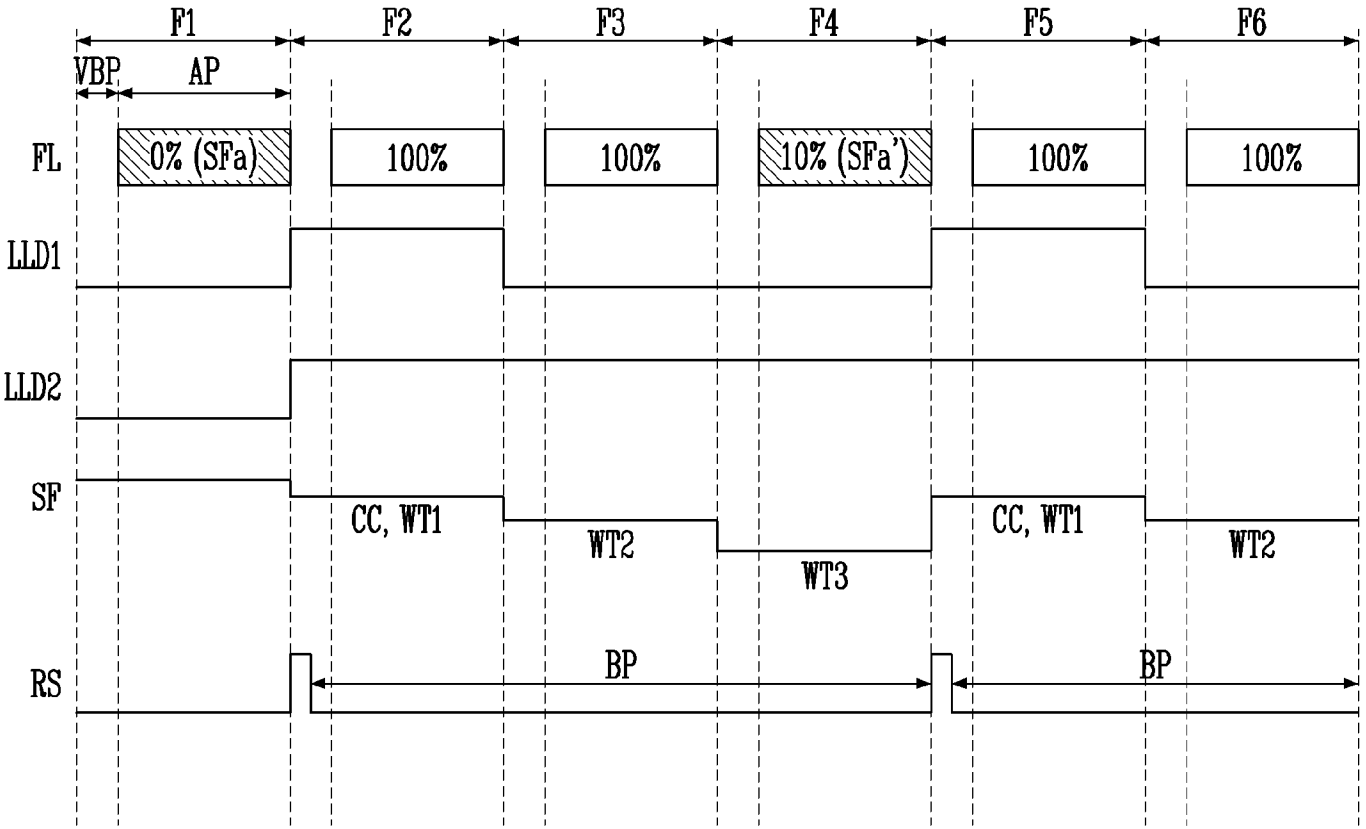
FIG. 6 is a timing diagram illustrating an example of an operation of the current limiter shown in FIG. 3, which adjusts a scale factor according to a frame load.

FIG. 6 illustrates an example of an operation of the current limiter shown in FIG. 3, which adjusts a scale factor according to a frame load.

Referring to FIGS. 3 and 6, a frame having a frame load FL smaller than the threshold load LTH may be inserted while the buffer period BP progresses.

In an embodiment, the resetter 570 may output the count reset signal when both the first control signal LLD1 and the second control signal LLD2 are activated. For example, as shown in FIG. 6, a count reset signal RS may be output in a vertical blank period VBP of the second frame F2 and a vertical blank period VBP of the fifth frame F5.

The counter 550 may reset a count value CV in response to the count reset signal RS. The buffer period BP may be restarted according to the reset count value CV. For example, a frame in which the count reset signal RS is output may be a first frame of the buffer period BP, and a first time weight WT1 may be output.

An operation up to the first to fourth frames F1 to F4 is substantially identical to that described with reference to FIG. 5, and therefore, overlapping descriptions will be omitted. That is, the scale factor SF may be gradually decreased up to the fourth frame F4.

In an embodiment, the buffer period BP may be set to basically include six consecutive frames. Accordingly, when the second control signal LLD2 is activated, the second control signal LLD2 can maintain the activation level during six frames as long as the second control signal LLD2 is not intentionally changed.

In an embodiment, a frame load FL of the fourth frame F4 is 10%, and may be smaller than the threshold load LTH. A scale factor stored in the lookup table (e.g., 522 shown in FIG. 4) corresponding to the frame load FL of 10% may be defined as SFa'.

Since the frame load FL of the fourth frame F4 is smaller than the threshold load LTH, the first control signal LLD1 may be again activated in the fifth frame F5. Since both the first and second control signals LLD1 and LLD2 have the activation level, the count reset signal RS may be again output. Accordingly, a previous buffer period BP may be reset, and a new buffer period BP may be again started. For example, the new buffer period BP may progress during the fifth frame F5 to the sixth frame F6.

In addition, in the fifth frame SF, a compensation coefficient CC may be applied a load scale factor LSF (e.g., SFa) corresponding to the frame load FL (e.g., 10%) of the fourth frame F4 (e.g., SFa'*CC) in response to the first control signal LLD1. In addition, the first time weight W1 may be again output by the count value CV reset in response to the count reset signal RS. Therefore, a new scale factor (e.g., SFa'*CC*WT1) may be generated in the fifth frame F5. For example, in the fifth frame F5, the scale factor SF may increase as compared with the fourth frame F4.

Subsequently, the frame load FL of the fifth frame F5 and the sixth frame F6 may again exceed the threshold load LTH, and the scale factor SF may be gradually decreased.

Figure 7:
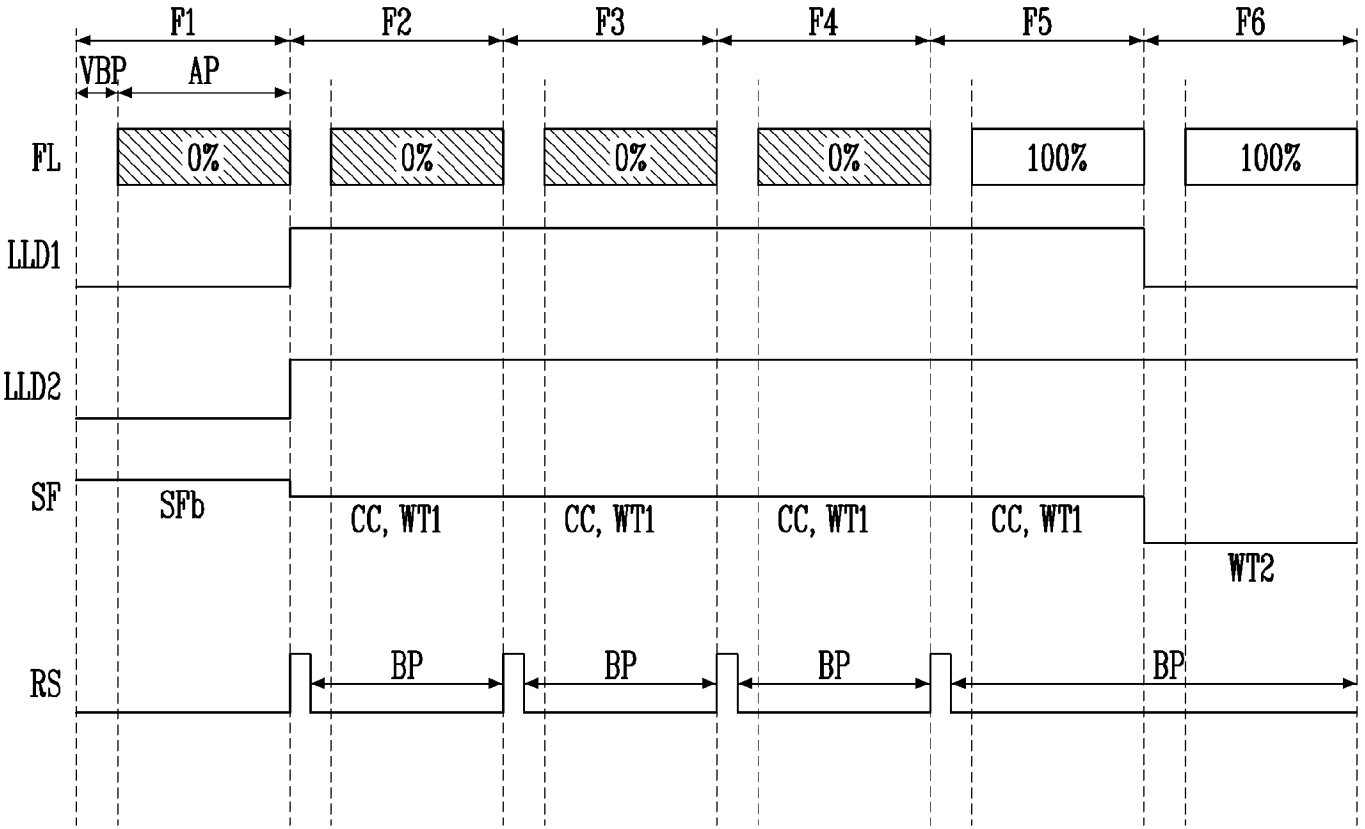
FIG. 7 is a timing diagram illustrating an example of an operation of the current limiter shown in FIG. 3, which adjusts a scale factor according to a frame load.

FIG. 7 illustrates an example of an operation of the current limiter shown in FIG. 3, which adjusts a scale factor according to a frame load.

Referring to FIGS. 3 and 7, frames having frame loads FL smaller than the threshold load LTH may be consecutive.

Frame loads FL of the first to fourth frames F1 to F4 may be smaller than the threshold load LTH. In addition, a scale factor SF of the first frame F1 may have SFb.

Driving identical to that of the second frame F2, which is described with reference to FIG. 5, may be performed on each of the second to fifth frames F2 to F5. For example, the first and second control signals LLD1 and LLD2 may be activated by a frame load FL of the first frame FL, which is 0%, in the second frame F2. Accordingly, the count reset signal RS may be output in the vertical blank period VB of the second frame F2, and the compensation coefficient CC and the first time weight WT1 may be applied to a load scale factor LSF corresponding to the frame load FL (e.g., the frame load of 0%) of the first frame F1. The load scale factor LSF may be equal to or different from SFb according to a frame load FL of a frame prior to the first frame F1.

Similarly, the activation level of the first and second control signals LLD1 and LLD2 may be maintained by the frame load FL of the second frame F2, which is 0%, in the third frame F3. Therefore, the count reset signal RS may be output in the vertical blank period VBP of the third frame F3, and the compensation coefficient CC and the first time weight WT1 may be applied to a load scale factor LSF corresponding to the frame load LF (e.g., the frame load of 0%) of the second frame F2.

As shown in FIG. 7, frame loads FL of the first to fourth frames F1 to F4, which are smaller than the threshold load LTH, are the same, and therefore, scale factors SF of the second to fifth frames F2 to F5 may be the same.

A frame load FL of 100%, which is greater than the threshold load LTH, may be output in the fifth frame F5. Therefore, the first control signal LLD1 may be inactivated in the sixth frame F6, and a value obtained by further applying a second time weight WT2 to the scale factor SF of the fifth frame F5 may be output as a scale factor SF of the sixth frame F6. The buffer period BP may be counted from the fifth frame F5.

Accordingly, when an image having a low load is continuously output, a scale factor SF is not decreased with an excessively small value, but may maintain a certain level according to a frame load FL of a previous frame.

Figure 8:
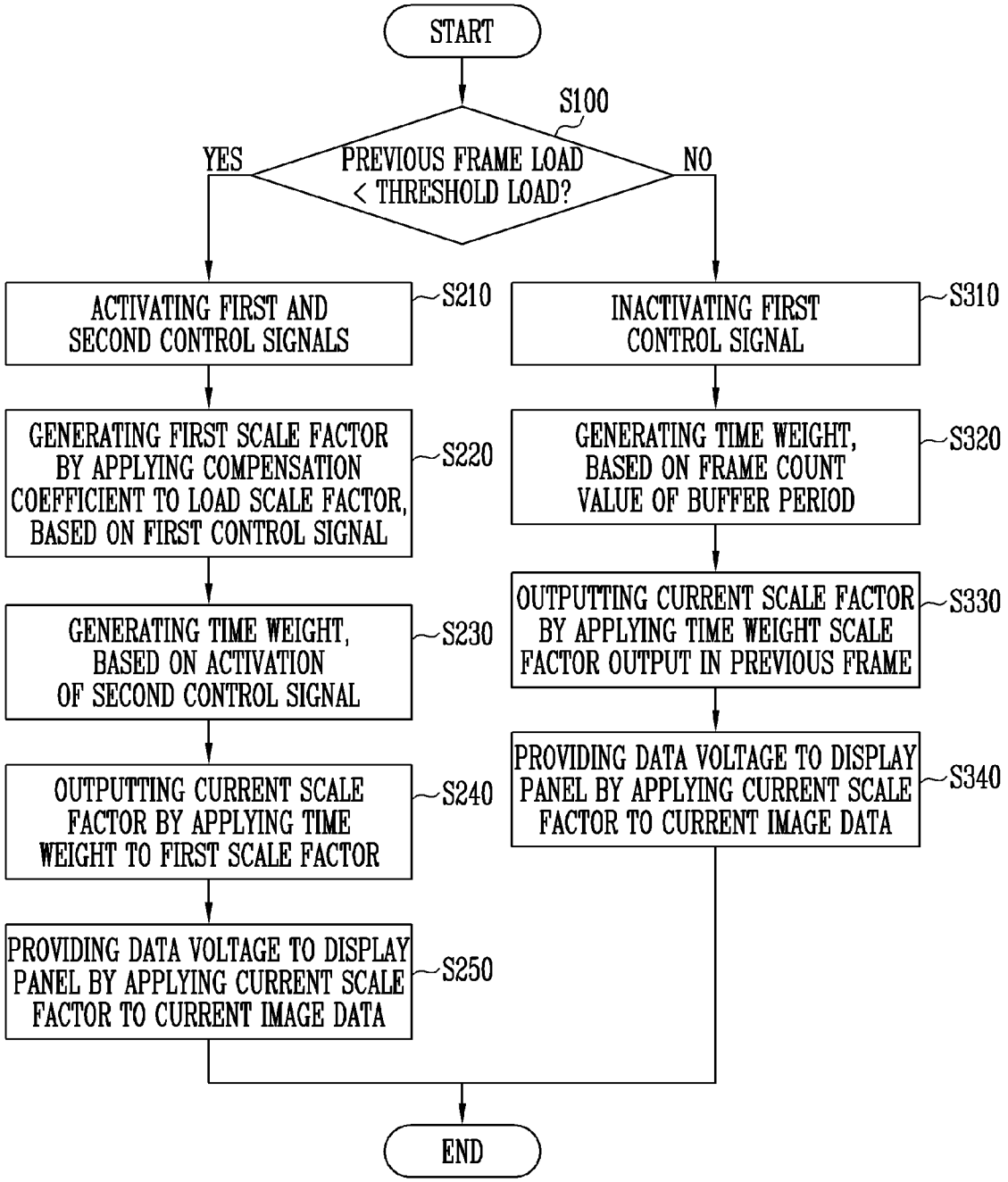
FIG. 8 is a flowchart diagram illustrating a method of driving a display device in accordance with an embodiment of the present disclosure.

FIG. 8 illustrates a method of driving the display device in accordance with embodiments of the present disclosure.

Referring to FIG. 8, in the method, a current scale factor applied to current image data may be calculated based on a result obtained by comparing a previous frame load with a threshold load (S100).

In an embodiment, when the previous frame load is smaller than the threshold load, a first control signal and a second control signal may be activated S210. A first scale factor may be generated by applying a compensation coefficient to a load scale factor corresponding to the previous frame load, based on the first control signal S220.

In addition, a time weight may be generated based on the activation of the second control signal S230. The second control signal may be activated during a buffer period including a plurality of consecutive frames. The time weight may vary within the buffer period. For example, a time weight corresponding to a result obtained by counting frames of buffer periods may be determined.

Subsequently, the current scale factor may be output by applying the time weight to the first scale factor S240. In addition, compensated image data may be generated by applying the current scale factor to the current image data, and a data voltage corresponding to the compensated image data may be provided to the display panel S250.

In an embodiment, when the previous frame load is smaller than the threshold load, and a current frame load is greater than the threshold load (e.g., when a frame load rapidly increases), a scale factor of a current frame may be smaller than that of a previous frame.

In an embodiment, when the previous frame load is equal to or greater than the threshold load, the first control signal may be inactivated S310. In addition, a time weight may be generated based on the second control signal and a frame count value of the buffer period S320.

The current scale factor may be output by applying the time weight to a scale factor output in the previous frame S330. The scale factor output in the previous frame has a meaning different from that of the above-described load scale factor. That is, load scale factor is not related to the scale factor output in the previous frame, and may be determined substantially by the previous frame load.

Subsequently, compensated image data may be generated by applying the current scale factor to the current image data, and a data voltage corresponding to the compensated image data may be provided to the display panel S340.

However, the method has been described in detail with reference to FIGS. 3 to 7, and therefore, overlapping descriptions will be omitted to avoid redundancy.

As described above, in the display device and the method of driving the same in accordance with the embodiments of the present disclosure, a scale factor applied to current image data can be adjusted for electrical current limitation, based substantially on a previous frame load without comparing image data (or frame loads) of adjacent frames, using the frame memory.

Accordingly, image quality degradation due to generation and application of a scale factor delayed by one frame according to image data comparison by using the frame memory may be improved, and power consumption may be further reduced. In addition, since the adjustment of a scale factor is immediately (in real time) reflected based on the previous frame load, an over-current (overshoot of current) when the frame load (and the current amount of the display panel) rapidly increases may be prevented.

Further, since the scale factor applied to the current image data may be gradually decreased toward the target scale factor by the time weight provided throughout a few frames (e.g., during the buffer period), image distortion or the like due to current limitation corresponding to a rapid change in frame load can be reduced.

Embodiments have been disclosed herein for illustrative purposes, and although specific terms are employed, these are intended and to be interpreted in a generic and descriptive sense rather than for purposes of limitation. In some instances, as would be apparent to one of ordinary skill in the pertinent art as of the filing of the present application, features, characteristics, and/or elements described in connection with a particular embodiment may be used singly or in combination with features, characteristics, and/or elements described in connection with other embodiments unless specifically disclaimed. Accordingly, it will be understood by those of ordinary skill in the pertinent art that various changes in form and details may be made without departing from the scope and spirit of the present disclosure as set forth in the following claims.

What is claimed is:

1. A display device comprising:

a display panel including pixels configured to emit light based on a data voltage;

a current limiter configured to determine a scale factor by comparing a previous frame load with a predetermined threshold load, and generate compensated image data by applying the scale factor to current image data as input image data of a current frame to adjust the data voltage; and a data driver configured to convert the compensated image data into the data voltage and provide the data voltage to the display panel.

2. The display device of claim 1, wherein, when the previous frame load is smaller than the threshold load, and a current frame load is greater than the threshold load, a scale factor of the current frame is smaller than that of a previous frame.

3. The display device of claim 1, wherein the current limiter generates a time weight, based on the previous frame load and a frame lapse time, and further applies the time weight to the scale factor.

4. The display device of claim 3, wherein the scale factor and the time weight are greater than 0 and are equal to or smaller than 1.

5. The display device of claim 3, wherein, when a frame load of a first frame is equal to or smaller than the threshold load, and frame loads of second to kth (k is an integer greater than 2) frames are greater than the threshold load, a magnitude of a data voltage corresponding to the same grayscale is gradually decreased as approaching the kth frame from the second frame.

6. The display device of claim 5, wherein the scale factor to which the time weight is applied is gradually decreased as approaching the kth frame from the second frame.

7. The display device of claim 1, wherein the current limiter comprises:

a load calculator configured to calculate the previous frame load, based on input image data of a previous frame;

a signal controller configured to compare the previous frame load with the threshold load, and output a first control signal, based on a comparison result; and a scale factor adjustor configured to adjust the scale factor, based on the previous frame load and the first control signal.

8. The display device of claim 7, wherein, when the previous frame load is smaller than the threshold load, the signal controller activates the first control signal, and wherein the scale factor adjustor generates a current scale factor by applying a compensation coefficient to a load scale factor corresponding to the previous frame load in response to the first control signal.

9. The display device of claim 8, wherein, when the previous frame load is equal to or greater than the threshold load, the signal controller inactivates the first control signal, and wherein the scale factor adjustor outputs, as the current scale factor, a previous scale factor output in the previous frame.

10. The display device of claim 9, wherein, when the previous frame load is smaller than the threshold load, the signal controller further outputs a second control signal activated during a buffer period including a plurality of frames.

11. The display device of claim 10, wherein the current limiter further comprises:

a counter configured to output a count value by counting frames of the buffer period;

a weight generator configured to generate a time weight which varies in the buffer period in response to the second control signal and the count value; and a calculator configured to apply the time weight to the current scale factor.

12. The display device of claim 11, wherein the current limiter further comprises:

a resetter configured to output a count reset signal when both the first control signal and the second control signal are activated, and wherein the counter resets the count value in response to the count reset signal.

13. The display device of claim 12, wherein the weight generator outputs a first time weight corresponding to a first frame of the buffer period in response to the count reset signal.

14. The display device of claim 7, wherein the signal controller comprises:

a lookup table including a load scale factor corresponding to the previous frame load; and a comparator configured to output a second control signal for controlling generation of the first control signal and the time weight by comparing the previous frame load with the threshold load.

15. The display device of claim 11, wherein the current limiter generates the compensated image data by applying, to the current image data, the current scale factor to which the time weight is applied.

16. A method of driving a display device, the method comprising:

comparing a previous frame load with a predetermined threshold load;

activating a first control signal and a second control signal, when the previous frame load is smaller than the threshold load;

generating a first scale factor by applying a compensation coefficient to a load scale factor corresponding to the previous frame load, based on the first control signal;

generating a time weight, based on the activation of the second control signal;

outputting a current scale factor by applying the time weight to the first scale factor; and providing a data voltage to a display panel by applying the current scale factor to current image data.

17. The method of claim 16, wherein the second control signal is activated during a buffer period including a plurality of frames.

18. The method of claim 17, further comprising:

inactivating the first control signal, when the previous frame load is equal to or greater than the threshold load;

generating the time weight, based on the second control signal;

outputting the current scale factor by applying the time weight to a scale factor output in a previous frame; and providing a data voltage to the display panel by applying the current scale factor to current image data.

19. The method of claim 18, wherein the time weight is determined by counting frames of the buffer period.

20. The method of claim 16, wherein, when the previous frame load is smaller than the threshold load, and a current frame load is greater than the threshold load, a scale factor of the current frame is smaller than that of a previous frame.

* * * * *